US009389017B2

(12) United States Patent
Swart

(10) Patent No.: US 9,389,017 B2
(45) Date of Patent: Jul. 12, 2016

(54) APPARATUS FOR USE IN DRYING GRAIN

(75) Inventor: Werner Sybrand Swart, Welkom (ZA)

(73) Assignee: DRYLOBAG INTERNATIONAL PTY (LTD), Welkom (ZA)

( * ) Notice: Subject to any disclaimer, the term of this patent is extended or adjusted under 35 U.S.C. 154(b) by 300 days.

(21) Appl. No.: 14/118,947

(22) PCT Filed: Mar. 27, 2012

(86) PCT No.: PCT/IB2012/051445

§ 371 (c)(1),
(2), (4) Date: Apr. 7, 2014

(87) PCT Pub. No.: WO2012/160451

PCT Pub. Date: Nov. 29, 2012

(65) Prior Publication Data

US 2014/0223764 A1 Aug. 14, 2014

(30) Foreign Application Priority Data

May 20, 2011 (ZA) ..... 2011/03702

(51) Int. Cl.
*F26B 19/00* (2006.01)
*F26B 21/00* (2006.01)
*F26B 9/00* (2006.01)

(52) U.S. Cl.
CPC ..... *F26B 21/004* (2013.01); *F26B 9/006* (2013.01); *F26B 2200/06* (2013.01)

(58) Field of Classification Search
CPC ..... F26B 19/00; F26B 21/00; F26B 21/06
USPC ..... 34/104, 105
See application file for complete search history.

(56) References Cited

U.S. PATENT DOCUMENTS 5,297,377 A * 3/1994 Cullen ..... A01F 25/14 100/100
5,417,736 A 5/1995 Meyer
5,452,562 A * 9/1995 Cullen ..... B65B 1/04 53/428
5,461,843 A * 10/1995 Garvin ..... A01F 25/14 53/434
5,632,798 A * 5/1997 Funk ..... C05F 17/00 435/187
6,911,340 B1 * 6/2005 Cullen ..... C05F 17/00 435/290.1

(Continued)

FOREIGN PATENT DOCUMENTS

BG 611 Y1 * 5/2003
CN WO 2014000132 A1 * 1/2014 ..... B07B 11/02
GB 474657 A * 11/1937 ..... B07B 1/24

(Continued)

OTHER PUBLICATIONS

Silo Bag Research, Department Grain Science & Industry, Kansas State University, Nov. 2010.*

(Continued)

*Primary Examiner* — Steve M Gravini
(74) *Attorney, Agent, or Firm* — Young & Thompson

(57) ABSTRACT

An apparatus for use in the drying of grain and more particularly but not exclusively, to a grain storage bag having grain drying capabilities, includes an elongate flexible container having an air inlet arrangement and an air outlet arrangement, with the air inlet arrangement being in flow communication with the air outlet arrangement through an internal volume of the container. The apparatus also includes fluid displacement elements for causing airflow from the air inlet arrangement to the air outlet arrangement.

12 Claims, 3 Drawing Sheets

(56) References Cited

U.S. PATENT DOCUMENTS

| | | | | |
|---|---|---|---|---|
| 2009/0094853 | A1 | 4/2009 | Noyes et al. | |
| 2014/0223764 | A1 * | 8/2014 | Swart | F26B 9/006 34/443 |

FOREIGN PATENT DOCUMENTS

| | | | | |
|---|---|---|---|---|
| JP | 2002098477 | A * | 4/2002 | |
| JP | 2008180489 | | 8/2008 | |
| KR | 20100033338 | | 3/2010 | |
| ZA | WO 2012160451 | A1 * | 11/2012 | F26B 9/006 |

OTHER PUBLICATIONS

International Search Report dated Jun. 6, 2012, corresponding to PCT/IB2012/051445.

* cited by examiner

APPARATUS FOR USE IN DRYING GRAIN

BACKGROUND TO THE INVENTION

THIS invention relates to an apparatus for use in the drying of grain and more particularly but not exclusively, to a grain storage bag having grain drying capabilities.

In the specification the term grain should be interpreted to include a variety of harvested crops that are found in agriculture, including but not limited to cereal grains, grain legumes and oilseeds.

Grain drying, as used in this specification, refers to the removal of some of the moisture from grain by mechanically moving air through the grain after it has been harvested. Grain in the field dries naturally as the crop matures, giving up moisture to the air until the grain moisture is in equilibrium with the moisture in the air. However, grain often needs to be dried even further after harvesting before it can be delivered to the market. If no drying facility is available the harvesting process may come to a standstill, which in turn adversely influences production cost and the planting of a next batch of crop.

A number of grain drying methods and apparatuses have been proposed in the past, and include drying floors, bin-type dryers, drying wagons and drying cribs and solar dryers. However, these methods all have disadvantages associated therewith, including the high capital cost of the drying facilities, the complicated nature of some of the drying facilities, and the limited control associated with some of the drying facilities.

It is accordingly an object of the invention to provide an apparatus for use in drying grain that will, at least partially, alleviate the above disadvantages.

It is also an object of the invention to provide an apparatus for drying grain which will be a useful alternative to existing grain drying facilities.

SUMMARY OF THE INVENTION

According to the invention there is provided an apparatus for use in drying grain, the apparatus including:

- an elongate flexible container suitable for receiving grain, the container being at least partially sealable once grain has been introduced therein;
- the container having an air inlet arrangement, and an air outlet arrangement, with the air inlet arrangement being in flow communication with the air outlet arrangement through an internal volume of the container; and
- fluid displacement means for facilitating airflow from the air inlet arrangement to the air outlet arrangement.

There is provided for the flexible container to be in the form of an elongate cylindrical container, and for the air inlet arrangement and the air outlet arrangement to be located towards opposing sides of the container.

The air inlet arrangement may be in the form of a header that extends adjacent a side of the container, the header having at least one inlet that is in flow communication with the fluid displacement means, and a plurality of outlets that are in flow communication with the internal volume of the container.

Preferably, a longitudinal axis of the elongate container is horizontal, and the header is substantially parallel to the longitudinal axis of the container.

The air inlet arrangement may be located at a distal zone of the header, and may alternatively be located at a proximal zone of the header. There is also provided for the air inlet arrangement to include a plurality of inlets.

The outlets of the air inlet arrangement may be defined by a plurality of apertures in the header that overlie corresponding apertures in the sidewall of the container.

The air outlet arrangement may be in the form of a plurality of apertures provided in a sidewall of the container opposite the sidewall where the inlet arrangement is located.

In another embodiment, the air outlet arrangement may be in the form of a collecting header that extends adjacent a side of the container opposite the side where the air inlet arrangement is located, the header having a plurality of inlets which are in flow communication with the internal volume of the container, and an outlet which is in flow communication with the environment. The inlets of the air outlet arrangement may be defined by a plurality of apertures in the header that overlie corresponding apertures in the sidewall of the container.

There is provided for the container to be in the form of an elongate bag, and more particularly a polymeric silo bag.

The air displacement means is preferably in the form of a fan.

A heater may also be provided to heat the air being displaced into the container.

A further embodiment of the invention provided for the air inlet arrangement to be in the form of a plurality of air inlet pipes extending longitudinally into the container, and for the air-outlet arrangement to be defined by one or more apertures provided in an upper wall of the container.

The air inlet pipes may include apertures in sidewalls thereof, which apertures are in flow communication with an internal volume of the container. Open ends of the pipes may be in flow communication with a fluid displacement means.

A still further embodiment of the invention provides for the air inlet arrangement to be in the form of a plurality of air supply pockets located below the container, the air supply pockets having inlets that are in flow communication with a fluid displacement means, and outlets that are in flow communication with an internal volume of the container.

Inflatable lifting pockets may be provided in-between air supply pockets, and will serve to displace the bottom wall of the container upwardly.

According to a further aspect of the invention there is provided a method of drying grain, the method including:

- providing an elongate flexible container suitable for receiving grain, the container being at least partially sealable once grain has been introduced therein, and the container having an air inlet arrangement, and an air outlet arrangement, with the air inlet arrangement being in flow communication with the air outlet arrangement through an internal volume of the container;
- filling the container with grain; and
- inducing airflow from the air inlet arrangement to the air outlet arrangement.

BRIEF DESCRIPTION OF THE DRAWINGS

A preferred embodiment of the invention is described by way of a non-limiting example, and with reference to the accompanying drawings in which.

DETAILED DESCRIPTION OF INVENTION

Figure 1:
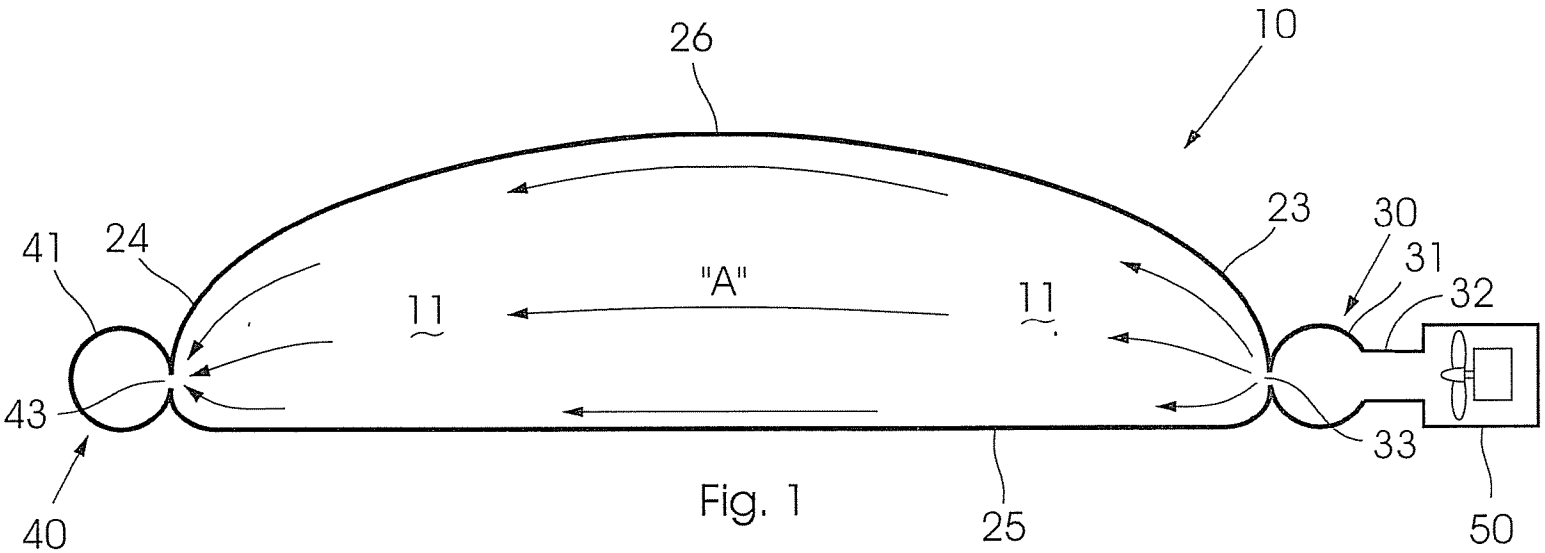
FIG. 1 is a cross-sectional end view of the apparatus in accordance with one embodiment of the invention.

Referring to the drawings, in which like numerals indicate like features, a non-limiting example of an apparatus for drying grain in accordance with the invention is generally indicated by reference numeral 10.

Figure 2:
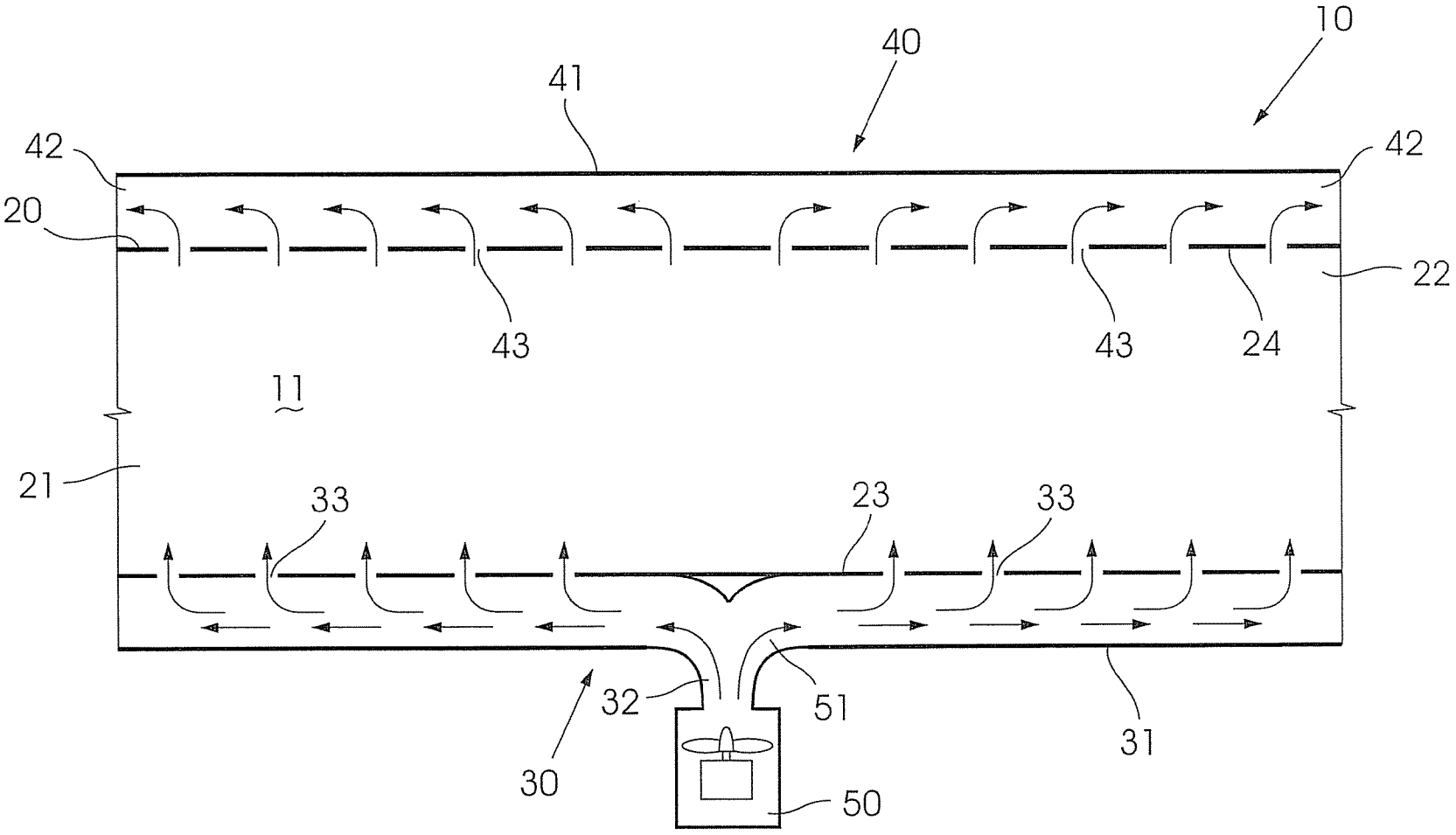
FIG. 2 is a cross-sectional plan view of the apparatus of FIG. 1.

With reference to FIGS. 1 and 2, the apparatus 10 comprises a container 20, which is in the form of an elongate flexible bag, which is made of a suitable polymeric material. The container is similar to storage bags already known in the trade, and which are sometimes referred to as silo bags. The detail design of the bag, as well as the loading and unloading of theses bags are not relevant to the invention.

The container 20 is cylindrical in nature, and comprises a continuous sidewall. For the purposes of clarity, reference will however be made to a first end 21, a second end 22, a first sidewall 23, a second sidewall 24, a bottom wall 25 and an upper wall 26. The container differs from similar containers found in industry, in that a plurality of inlet apertures 27 are provided in the first sidewall 23, and a plurality of outlet apertures 28 are provided in the second sidewall 24. The apertures on each side is aligned in a linear configuration, and a centerline through the apertures are generally parallel to a longitudinal axis of the container.

An air inlet arrangement 30 is provided adjacent the first sidewall 23 of the container 20. The air inlet arrangement 30 is in the form of an elongate tubular header 31 that extends along at least part of the length of the container 10. The header 31 has at least one inlet 32 which is in flow communication with a fluid displacement means 50, which is typically in the form of a fan. The inlet(s) can be closed off when there is no air flow through the system, so as to prevent the unwanted ingress of moisture and contaminants. The inlet configuration may differ, and is described in more detail below. A plurality of outlets 33 are provided in a sidewall of the header 31, and are configured and dimensioned to overlie the inlet apertures 27 provided in the container, thus bringing the header in flow communication with an internal volume of the container 10.

An air outlet arrangement 40 is provided adjacent the second sidewall 24 of the container 20. The air outlet arrangement 40 is also in the form of an elongate tubular header 41 that extends along at least part of the length of the container 10. The header 41 has at least one outlet 42 which is in flow communication with the environment. The outlet(s) can be closed off when there is no air flow through the system, so as to prevent the unwanted ingress of moisture and contaminants. A plurality of inlets 43 are provided in a sidewall of the header 41, and are configured and dimensioned to overlie the outlet apertures 28 provided in the container, thus bringing the header in flow communication with an internal volume of the container 10.

In use, the container 10 will be loaded with grain 11 to be dried and stored. The inlet 32 of the air inlet arrangement 30 will be opened, as will the outlet 42 of the air outlet arrangement 40, so as to define a flow passage from the air inlet arrangement 30 through the internal volume of the container 20 and into the outlet arrangement 40. When the fan 50 is activated, dry air will be forced through the container 20, and more particularly will be forced past the grain 11 inside the container. The air may be ambient air, but may also be heated by way of a heater (not shown). The air flow will result in the removal of moisture from the grain in a convective manner. Once a desired dryness has been achieved the fan 50 will be stopped, and the inlet 32 of the inlet arrangement 30, as well as the outlet 42 of the outlet arrangement 40 will be closed.

Figure 3A:
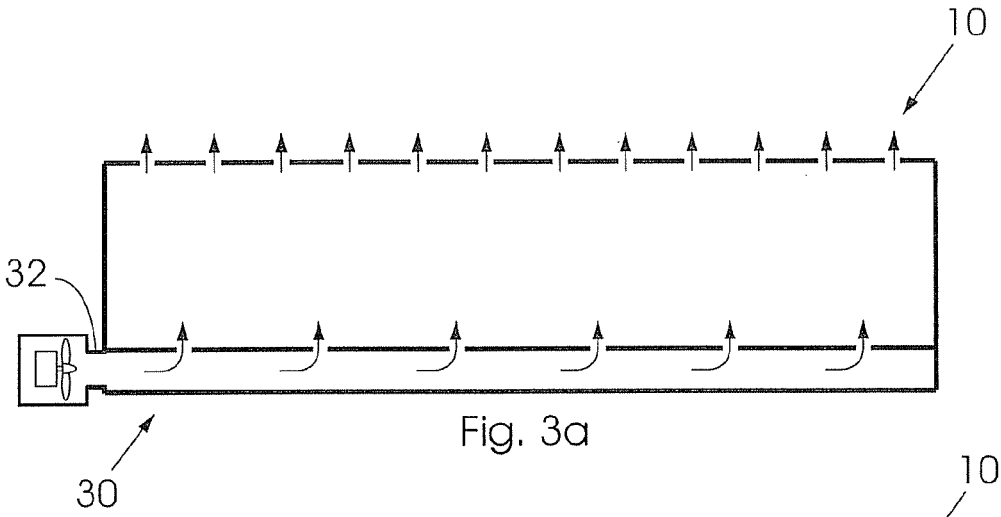
FIGS. 3*a* to 3*c* are schematic illustrations of a number of alternative inlet configurations for the apparatus of FIGS. 1 and 2.
Figure 3B:
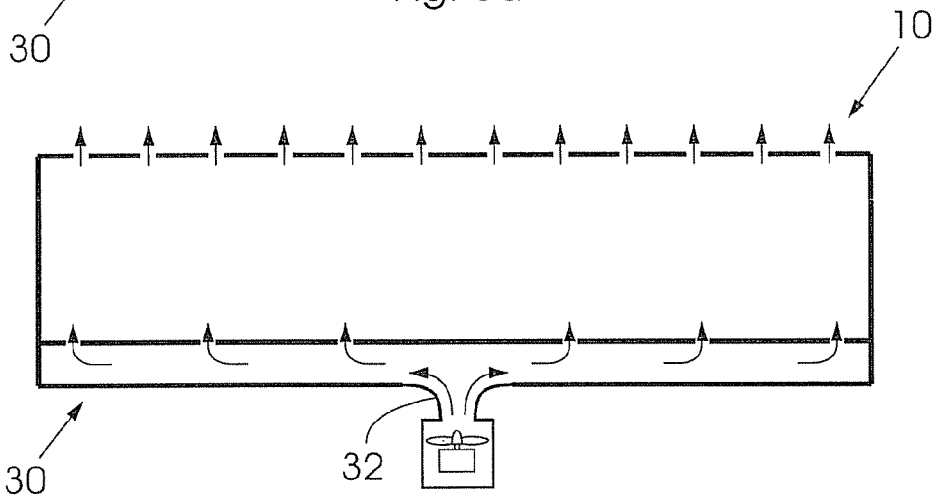
Figure 3C:
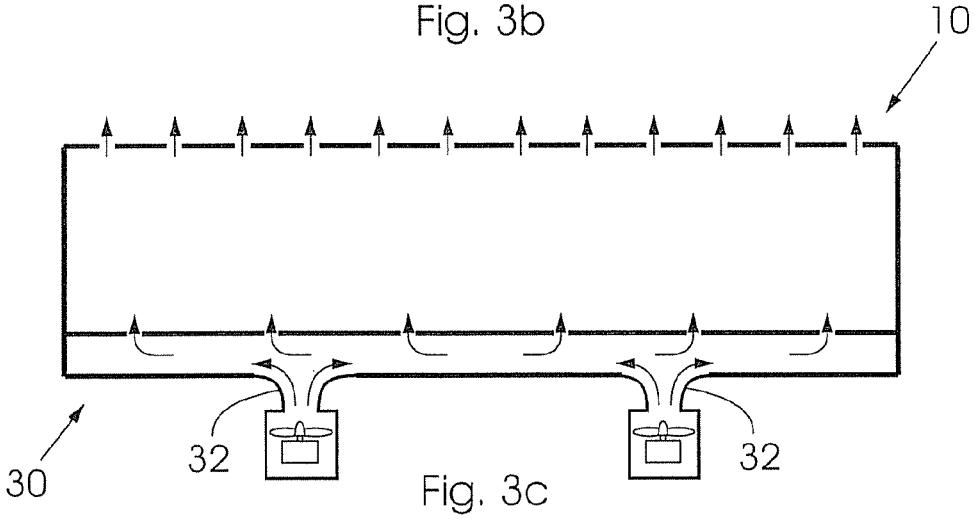

A number of inlet configurations are shown in FIGS. 3*a* to 3*c*, and entails an inlet at one distal end (FIG. 3*a*), an inlet at a proximal zone (FIG. 3*b*) which will also entail the use of a distribution plenum 51, and a plurality of inlets along the length of the header (FIG. 3*c*).

In is envisaged that the container may first be filled with grain, and that the air inlet arrangements will only be mounted on and secured to the container after the container has been filled with grain.

It is foreseen that other configurations may also be used to achieve the same result, which is to dry grains in an elongate flexible container. For example, the inlet arrangement may be in the form of a plurality of perforated pipes that extends longitudinally into the container, and which are located towards a bottom zone of the container. In this case the outlet arrangement will be at the top of the container, resulting in air flow in a vertical, upwardly direction. In a further example, the inlet arrangement may be in the form of a number of air supply pockets located immediately below the container, and which supply air through apertures in the container that corresponds with openings in the air supply pockets. In this embodiment it will be necessary to lift the bag and its contents in order to prevent the air supply pockets from collapsing, and lifting pockets will therefore be provided. The lifting pockets will not have outlets, thus enabling them to be inflated and to act as lifting cushions.

It will be appreciated that the above is only one embodiment of the invention and that there may be many variations without departing from the spirit and/or the scope of the invention.

The invention claimed is:

1. An apparatus for use in drying grain, the apparatus comprising:

an elongate flexible container with an internal volume suitable for receiving grain, the flexible container being at least partially sealable once grain has been introduced into the internal volume, the flexible container including a first end, a second end which opposes the first end, a first side wall, a plurality of inlet apertures in the first side wall, a second side wall which opposes the first side wall, a plurality of outlet apertures in the second side wall, a bottom wall, and an upper wall which opposes the bottom wall, the flexible container having i) an air inlet arrangement comprising at least one elongate tubular inlet header which is located outside of the internal volume, which extends along at least a part of a length of the container adjacent the first side wall and which is connectable to an air supply system, the at least one elongate tubular inlet header having an air inlet header side wall that includes a plurality of outlets which respectively overlie the inlet apertures in the first side wall of the elongate flexible container whereby air can be directed into the internal volume, and ii) an air outlet arrangement comprising at least one elongate tubular outlet header which is located outside of the internal volume and which extends along at least a part of a length of the container adjacent the second side wall, the at least one elongate tubular outlet header having an air outlet header side wall that includes a plurality of inlets which respectively overlie the outlet apertures in the second side wall of the elongate flexible container whereby the elongate tubular outlet header is in flow communication with the internal volume.

2. The apparatus of claim 1, wherein a longitudinal axis of the elongate container is horizontal, and the at least one elongate tubular inlet header and the at least one elongate tubular outlet header are substantially parallel to the longitudinal axis of the container.

3. The apparatus of claim 1, wherein the container is in the form of an elongate flexible bag.

4. The apparatus of claim 3, wherein the container is in the form of a polymeric silo bag.

5. The apparatus of claim 1, further comprising inflatable lifting pockets which in use serve to displace the bottom wall of the container upwardly.

6. The apparatus of claim 1 in combination with an air supply system.

7. The apparatus of claim 6, further comprising a heater for heating air which is displaced into the container by the air supply system.

8. The apparatus according to claim 1, wherein the bottom wall, the at least one elongate tubular inlet header and the at least one elongate tubular outlet header are ground engaging.

9. The apparatus according to claim 1, further comprising one outlet for placing the at least one elongate tubular outlet header in communication with the environment.

10. The apparatus according to claim 1, wherein the flexible container includes a continuous side wall comprising the first end, the second end, the first side wall, the second side wall, the bottom wall and the upper wall.

11. The apparatus according to claim 1, wherein the plurality of inlet apertures are aligned in a linear configuration.

12. The apparatus according to claim 1, wherein the plurality of outlet apertures are aligned in a linear configuration.

* * * * *